US010183728B2

(12) United States Patent
Shin

(10) Patent No.: US 10,183,728 B2
(45) Date of Patent: Jan. 22, 2019

(54) METHOD FOR CONVERSION OF A VESSEL FOR USE AS FLOATING LIQUEFIED NATURAL GAS FACILITY

(71) Applicant: Bechtel Hydrocarbon Technology Solutions, Inc., Houston, TX (US)

(72) Inventor: John Kwangho Shin, Houston, TX (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 90 days.

(21) Appl. No.: 15/113,810

(22) PCT Filed: May 19, 2014

(86) PCT No.: PCT/US2014/038584

§ 371 (c)(1),
(2) Date: Jul. 22, 2016

(87) PCT Pub. No.: WO2015/112188

PCT Pub. Date: Jul. 30, 2015

(65) Prior Publication Data

US 2016/0339999 A1 Nov. 24, 2016

Related U.S. Application Data

(60) Provisional application No. 61/930,559, filed on Jan. 23, 2014.

(51) Int. Cl.

| | |
|---|---|
| ***B63B 9/04*** | (2006.01) |
| ***B63B 25/08*** | (2006.01) |
| *B63B 9/00* | (2006.01) |

(52) U.S. Cl.
CPC ..... *B63B 9/04* (2013.01); *B63B 25/08* (2013.01); *B63B 2009/006* (2013.01)

(58) Field of Classification Search
CPC .... B63B 9/00; B63B 9/04; B63B 9/06; B63B 2009/005; B63B 2009/006; B63B 25/00; B63B 25/02; B63B 25/08
See application file for complete search history.

(56) References Cited

U.S. PATENT DOCUMENTS 3,406,650 A * 10/1968 Miller ..... B63B 9/04 114/45
5,189,975 A * 3/1993 Zednik ..... B63B 9/04 114/74 A (Continued)

FOREIGN PATENT DOCUMENTS

JP 53040995 A * 4/1978
JP 59164281 A * 9/1984

(Continued)

OTHER PUBLICATIONS

D.G. Park and H.S. Kim, Notice to File a Response, Korean Patent Application No. 10-2016-7022436, May 13, 2017, 23 pages, Korean Intellectual Property Office, Korea.

(Continued)

*Primary Examiner* — Ajay Vasudeva
(74) *Attorney, Agent, or Firm* — Crain, Caton and James

(57) ABSTRACT

A method for conversion of a Very Large Ore Carrier (VLOC) to an FLNG vessel for offshore stranded gas reservoirs and at-shore or near-shore Liquefied Natural Gas (LNG) export terminals.

14 Claims, 10 Drawing Sheets

(56) References Cited

U.S. PATENT DOCUMENTS

| | | | | |
|---|---|---|---|---|
| 6,170,420 | B1 * | 1/2001 | Hagner | B63B 3/20 114/65 R |
| 2005/0204982 | A1 | 9/2005 | Neu | |
| 2011/0192339 | A1 | 8/2011 | Chen et al. | |

FOREIGN PATENT DOCUMENTS

| | | | |
|---|---|---|---|
| JP | 62295787 | A2 | 10/1995 |
| JP | 2011-148358 | A2 | 8/2011 |
| JP | 2013-023129 | | 2/2013 |
| WO | 2002008052 | | 1/2002 |

OTHER PUBLICATIONS

Nam & Nam World Patent & Law Firm, Argument, Korean Patent Application No. Oct. 2016-7022436, Jul. 11, 2017, 5 pp., Nam & Nam World Patent & Law Firm, Korea.

Blaine R. Copenheaver, The International Search Report and the Written Opinion of the International Searching Authority, PCT Application No. PCT/US14/38584, dated Oct. 9, 2014, 9 pages, International Searching Authority, Alexandria, Virginia.

Ajay Vasudeva, International Preliminary Report on Patentability, PCT Application No. PCT/US14/38584, dated Feb. 12, 2016, International Preliminary Examining Authority, Alexandria, Virginia.

D.K. Park, Notice to File a Response, Korean Patent Application No. 10-2016-7022436, Nov. 29, 2017, 27 pages, Korean Intellectual Property Office, Korea.

Nam & Nam World Patent & Law Firm, Response to Office Action, Korean Patent Application No. 10-2016-7022436, dated Jan. 26, 2018, 7 pages, Nam & Nam World Patent & Law Firm, Korea.

* cited by examiner

METHOD FOR CONVERSION OF A VESSEL FOR USE AS FLOATING LIQUEFIED NATURAL GAS FACILITY

CROSS-REFERENCE TO RELATED APPLICATIONS

This Application claims priority from PCT Patent Application Ser. No. PCT/US14/38584, filed on May 19, 2014, which claims priority from U.S. Provisional Patent Application Ser. No. 61/930,559, filed on Jan. 23, 2014, which are incorporated herein by reference.

STATEMENT REGARDING FEDERALLY SPONSORED RESEARCH

Not applicable.

FIELD OF THE DISCLOSURE

The present disclosure generally relates to a method for conversion of a vessel for use as Floating Liquefied Natural Gas (FLNG) facility. More particularly, the present disclosure relates to a method for conversion of a Very Large Ore Carrier (VLOC) to an FLNG vessel for offshore stranded gas reservoirs and at-shore or near-shore Liquefied Natural Gas (LNG) export terminals.

BACKGROUND

There is an ongoing need for FLNG vessels. Unfortunately, supply has been unable to meet demand. Construction costs for FLNG vessels are high and construction times are relatively long.

Conversion of an existing vessel for use as an FLNG vessel could address these needs. Existing vessels could provide the powertrain and other crew-specific compartments and needs. Conversion would permit retention of those components, while providing for a shorter construction period, at a lower cost. Selection of an appropriate vessel type would also speed conversion due to diversity of selection in shipyards. Additionally, conversion of existing vessels could provide additional benefits, including the avoidance of energy-consumption to manufacture components—such as outer hull, crew quarters and powertrain. This could potentially reduce the carbon footprint of manufacture and the use of various chemicals and additives.

The use of a converted oil tanker as a donor for a Floating Production Storage and Offloading Oil Production vessel is a proven means of delivering a fast track and low cost floating facility. The FLNG market, however, is a relatively young and as yet no d tanker conversion solutions have been generated for conversion of existing vessels to an FLNG vessel. At best, an attempt has been made to utilize LNG trading tankers as donor vessels for such facilities. This presents challenges since the LNG carrier hull containment tanks are predominantly based on International Maritime Organization Type B Moss spherical tanks. In these vessels, these tanks consume much of the deck area and hull strength, rendering the topside space very restricted and inefficient for FNLG use.

BRIEF DESCRIPTION OF THE DRAWINGS

The present disclosure is described below with references to the accompanying drawings in which like elements are referenced with like reference numerals, and in which.

DETAILED DESCRIPTION OF THE PREFERRED EMBODIMENTS

Figure 1A:
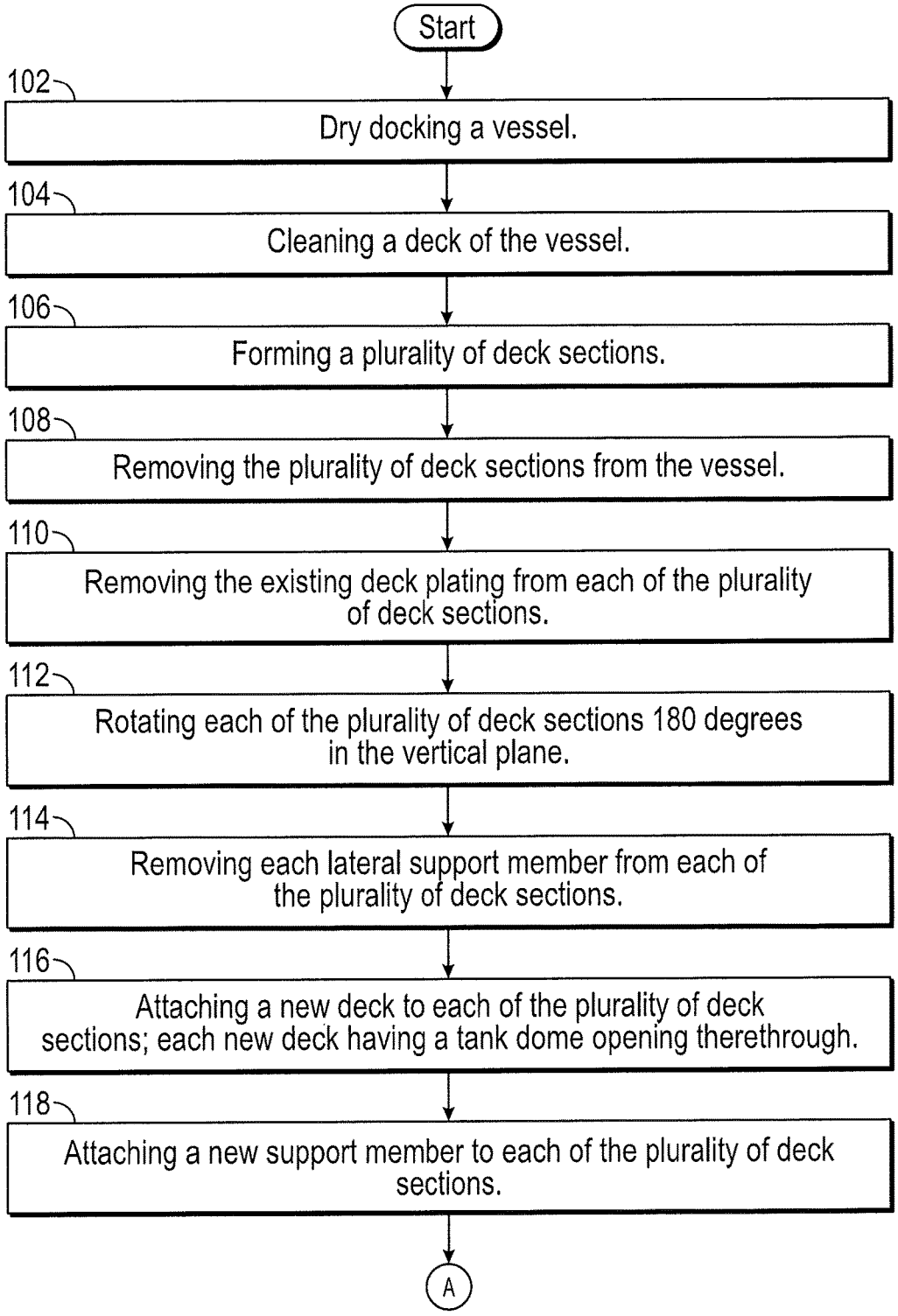
FIGS. 1A-1B are flow diagrams illustrating one embodiment of a method for implementing the present disclosure.

The present disclosure overcomes one or more deficiencies in the prior art by providing a method for conversion of a VLOC to an FLNG vessel for offshore stranded gas reservoirs and at-shore or near-shore LNG export terminals.

In one embodiment, the present disclosure includes a method for conversion of a floating vessel for use as FLNG facility, which comprises: (i) forming a plurality of deck sections; (ii) removing the plurality of deck sections from the vessel; (iii) removing a deck from each of the plurality of deck sections; (iv) rotating each of the plurality of deck sections 180 degrees in a vertical plane, (v) removing each lateral support member from each of the plurality of deck sections; (vi) attaching a new deck to each of the plurality of deck sections, each new deck having a tank dome opening therethrough; (vii) attaching a new support member to each of the plurality of deck sections; (viii) attaching an internal second hull to a lower hull side of the vessel; (ix) positioning a tank in each of the internal cargo holds, each tank having an upper tank section; (x) rotating further, each of the plurality of deck section 180 degrees in the vertical plane; and (xi) attaching each deck section to the vessel, wherein each tank dome opening is aligned with the upper tank section.

In another embodiment, the present disclosure includes a method for conversion of a floating vessel having an internal cargo hold for use as FLNG facility, which comprises: (i) forming a deck section above the internal cargo hold; (ii) removing the deck section from the vessel; (iii) removing a deck from the deck section; (iv) rotating the deck section 180 degrees in a vertical plane; (v) attaching a new deck to the deck section, the new deck having a tank dome opening therethrough; (vi) attaching a new support member to the deck section; (vii) attaching an internal second hull to a lower hull side of the vessel; (viii) positioning a tank in the internal cargo hold, the tank having an upper tank section; (ix) further rotating the deck section 180 degrees in the vertical plane; and (x) attaching the deck section to the vessel, wherein the tank dome opening is aligned with the upper tank section.

The subject matter of the present disclosure is described with specificity, however, the description itself is not intended to limit the scope of the disclosure. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present disclosure may be applied in the oil and gas industry, it is not limited thereto and may also be applied in other industries to achieve similar results.

Method Description

VLOC vessels provide a donor tanker hull having a large unobstructed cargo tank, with high longitudinal strength and which are capable of accepting turret mounting. Additionally VLOC vessels provide a durable bottom hull configuration and have a deck configuration which allows modification for under-deck stiffening. Moreover, there are likely more than 150 available donor vessels.

Conversion of VLOCs to provide Floating Liquefied Natural Gas (FLNG) facilities, would therefore, meet the demand while providing substantial benefits over the wait for construction of specially-designed vessels. The user of a bulker utilized to transport iron ore, for example, provides a large open hull volume ideally suited for the space required to install special LNG tanks in a cost effective and timely manner. Conversion provides a reliable donor vessel with high structural integrity, requiring minimum modification, with a nominal 200,000 $m^3$ storage capacity, a large open deck area (90,000 T topsides) and a double bottom tanker. Conversion provides a shorter hull construction period at a lower hull construction cost, particularly given the diversity of selection in various shipyards, a list of benefits not otherwise available. This is due, in part, to the recycling of materials and machinery, which may approach up to 50% of the vessel. Thus, conversion may provide environmental benefits from the reduction of the carbon footprint needed for construction. The overall cost, however, ultimately varies depending on the existing hull structural condition and life.

Conversion, however, requires overcoming structural limitations of VLOCs, which may be accomplished through a series of steps. VLOC hulls must be upgraded to meet the requirements of FLNG. For example, FLNG vessels must be able to bear heavy topsides loads, but existing VLOC hull structures are designed for normal bulk cargo loading in the hull and, as such, the deck is generally designed to simply cover the cargo holds. Additionally strengthening therefore is needed of the hull sides and deck, which must not interfere with the tanks installed for performance of FLNG performance.

Figure 1B:
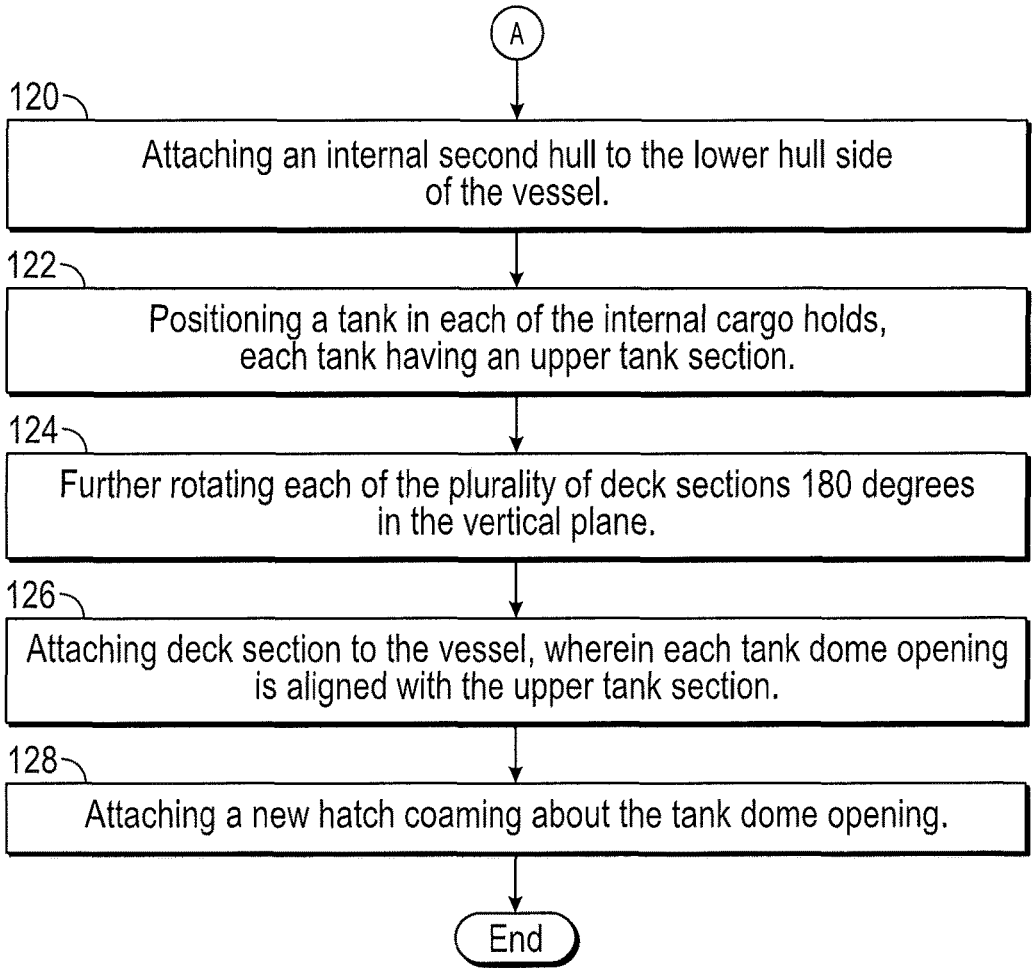

Referring now to FIG. 1A, a flow diagram 100 illustrates one embodiment for implementing the present disclosure. The method illustrated in FIG. 1A is continued in FIG. 1B.

Figure 2:
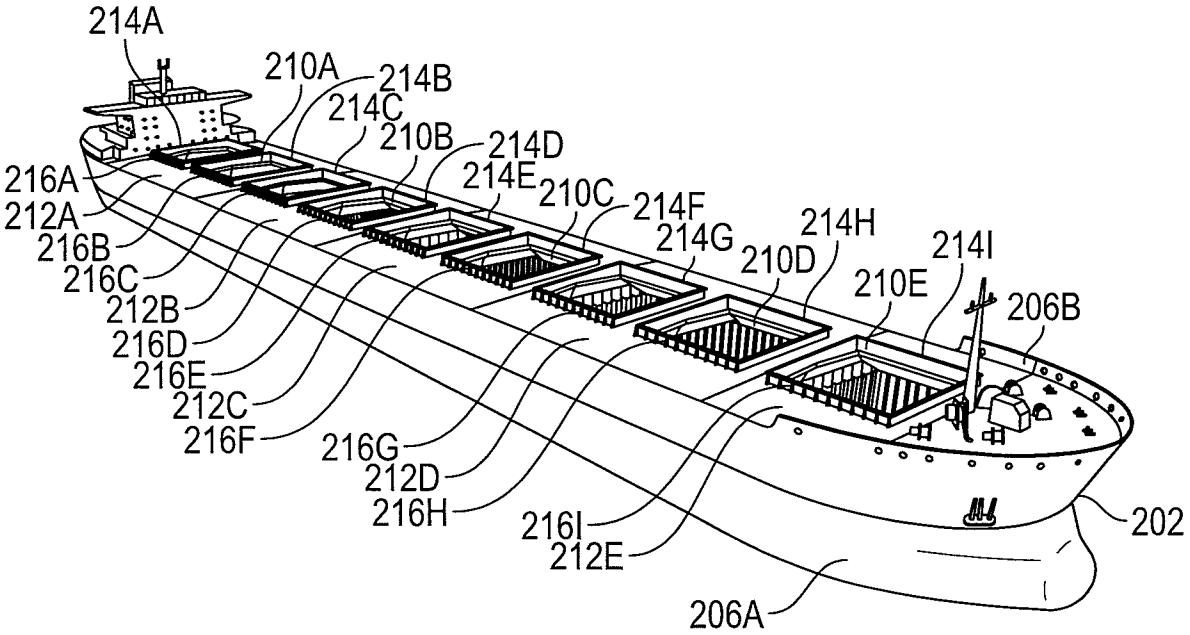
FIG. 2 is an isometric view of a vessel illustrating step 102 in FIG. 1A.

In step 102, a vessel 202, preferably a VLOC, is dry docked for conversion. Referring to FIG. 2, the vessel 202 has two hull sides 206A, 206B, a deck 212A, 212B, 212C, 212D, 212E, and one or more internal cargo holds 210A. The VLOC most typically has a plurality of internal cargo holds 210A, 210B, 210C, 210D, 210E. The deck, which includes 212A, 212B, 212C, 212D, 212E is positioned above the internal cargo holds 210A, 210B, 210C, 210D, 210E. The deck 212A, 212B, 212C, 212D, 212E includes at least one watertight cargo hatch openings 214A, 214B, 214C, 214D, 214E, 214F, 214G, 214H, 214I, which provides access to the internal cargo holds 210A, 210B, 210C, 210D, 210E. A hatch coaming 216A, 216B, 216C, 216D, 216E, 216F, 216G, 216H, 216I may be provided about each hatch opening 214A, 214B, 214C, 214D, 214E, 214F, 214G, 214H, 214I.

In step 104, the deck 212A, 212B, 212C, 212D, 212E is cleaned.

Figure 3:
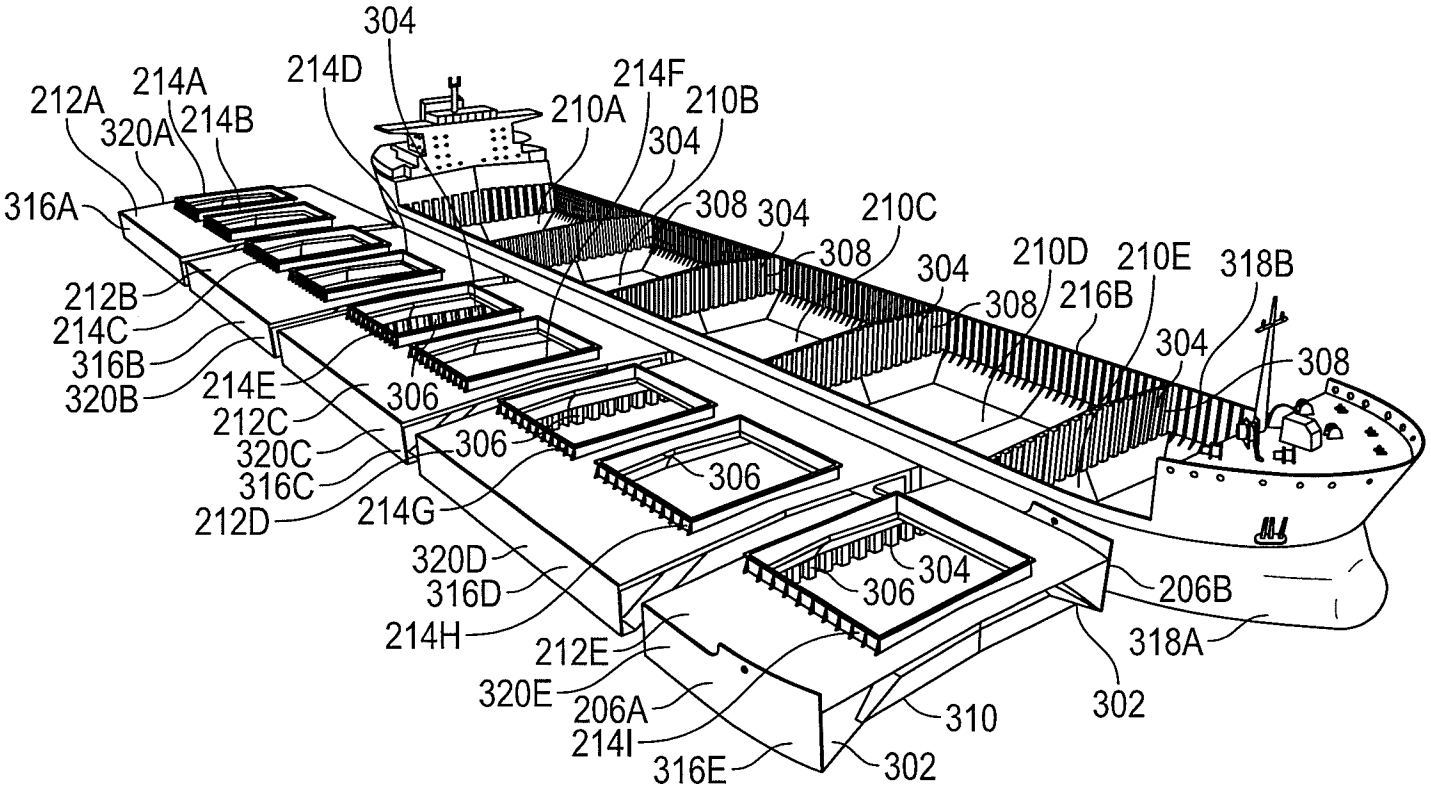
FIG. 3 is an isometric view of a vessel in FIG. 2 illustrating steps 106 and 108 in FIG. 1A.

In step 106, a plurality of deck sections 320A, 320B, 320C, 320D, 320E are formed. Each of the plurality of deck sections 320A, 320B, 320C, 320D, 320E is formed from the deck 212A, 212B, 212C, 212D, 212E, the two hull sides 206A, 206B, the longitudinal support members 302, lateral support members 310, and cargo hold inner walls 304, as illustrated in FIG. 3. Each cargo hold inner wall 304 bounds a side of an internal cargo hold 210A, 210B, 210C, 210D, 210E. Each of the two hull sides 206A, 206B has a connection to the longitudinal support members 302, which are also connected to, and provide support for, the deck 212A, 212B, 212C, 212D, 212E. Where two or more hatch openings 214A, 214B, 214C, 214D, 214E, 214F, 214G, 214H, 214I are provided to a single internal cargo hold 210A, 210B, 210C, 210D, 210E, a lateral support member 310 is positioned above and spans the internal cargo holds 212A, 212B, 212C, 212D, 212E from one hull side 206A to another 206B and are connected to, and provide support for, the deck 212A, 212B, 212C, 212D, 212E.

The plurality of deck sections 320A, 320B, 320C, 320D, 320E may be formed by dividing, i.e. cutting, the hull sides 206A, 206B, the cargo hold inner walls 304, and the deck 212A, 212B, 212C, 212D, 212E. Each of the two hull sides 206A, 206B of the vessel 202 is divided below the connection of a longitudinal support member 302 to the respective hull side 206A, 206B into an upper hull side shell 316A, 316B, 316C, 316D, 316E and a lower hull side 318A, 318B. Each cargo hold inner wall 304 is likewise divided below the connection of the longitudinal support member 302 to the hull sides 206A, 206B into a cargo hold upper inner wall 306 and a cargo hold lower inner wall 308. Finally, the deck 212A, 212B, 212C, 212D, 212E and the upper hull side shell 316A, 316B, 316C, 316D, 316E are laterally divided at each of the cargo hold upper inner walls 306. In an alternative embodiment, a single deck section is formed by dividing the hull sides 206A, 206B and the cargo hold inner walls 304, but not the deck 212A, 212B, 212C, 212D, 212E and the upper hull side shell 316A, 316B, 316C, 316D, 316E, resulting in a single large deck section. In a further alternative embodiment, deck sections are formed for less than all internal cargo holds 210A, 210B, 210C, 210D, 210E, such as by dividing the hull sides 206A, 206B, the cargo hold inner walls 304, and the deck 212A, 212B, 212C, 212D, 212E about only one, or two, of the internal cargo holds 210A, 210B, 210C, 210D, 210E, i.e. at less than each of the cargo hold upper inner walls 306, resulting in a hybrid vessel.

In step 108, each of the plurality of deck sections 320A, 320B, 320C, 320D, 320E is removed from the vessel, as illustrated in FIG. 3.

In step 110, the existing deck plates (which may also be referenced as lid steel) are removed from each of the plurality of deck sections 320A, 320B, 320C, 320D, 320E. The existing hatch coaming 216A, 216B, 216C, 216D, 216E, 216F, 216G, 216H, 216I may also be removed at this time.

Figure 4:
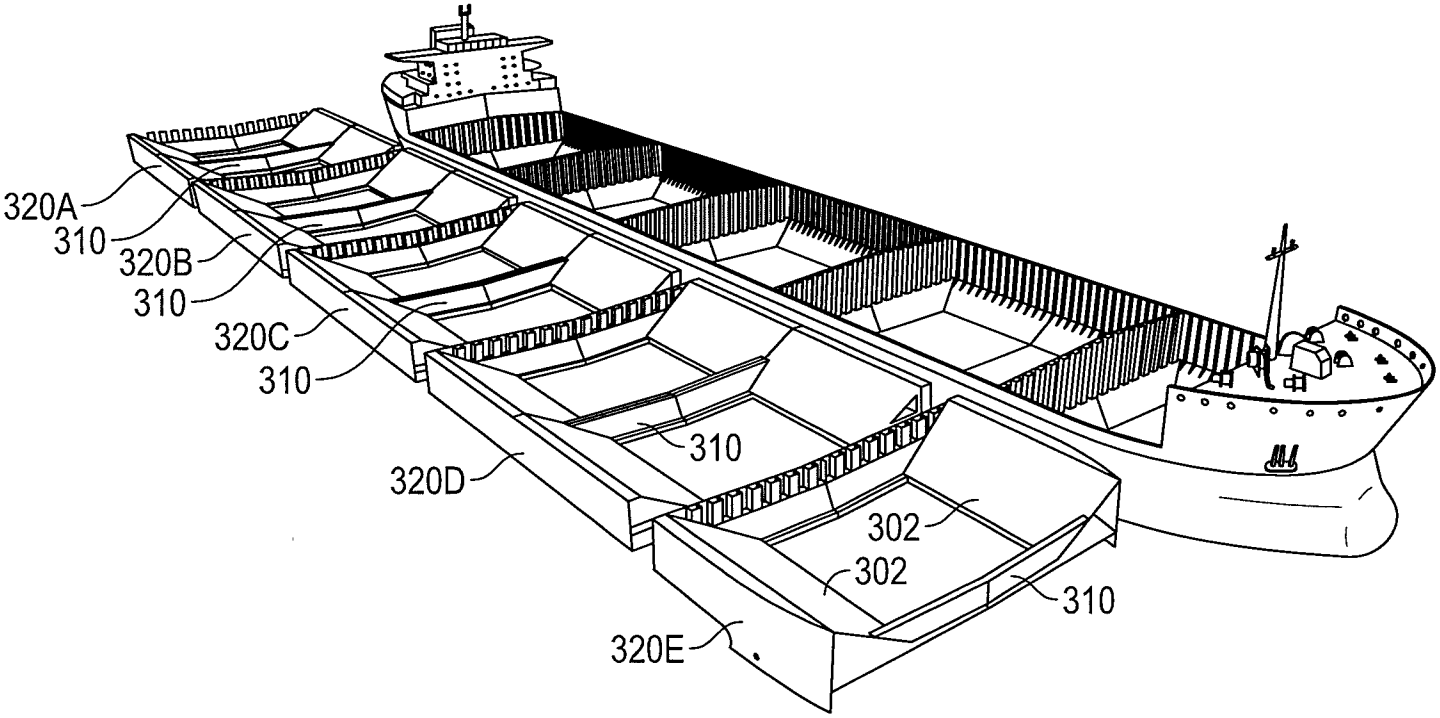
FIG. 4 is an isometric view of a vessel in FIG. 2 illustrating step 112 in FIG. 1A.

In step 112, each of the plurality of deck sections 320A, 320B, 320C, 320D, 320E is rotated 180 degrees in the vertical plane, i.e. flipped, as illustrated in FIG. 4, which may begin with the deck section 320A, 320B, 320C, 320D, 320E associated with a first internal cargo bay. Rotation, while not essential, permits access to the interior of each of the plurality of deck sections 320A, 320B, 320C, 320D, 320E from above and providing better access to the longitudinal support members 302 and to the lateral support members 310. Provided sufficient support is provided to each of the plurality of deck sections 320A, 320B, 320C, 320D, 320E, step 112 may be omitted.

Figure 5:
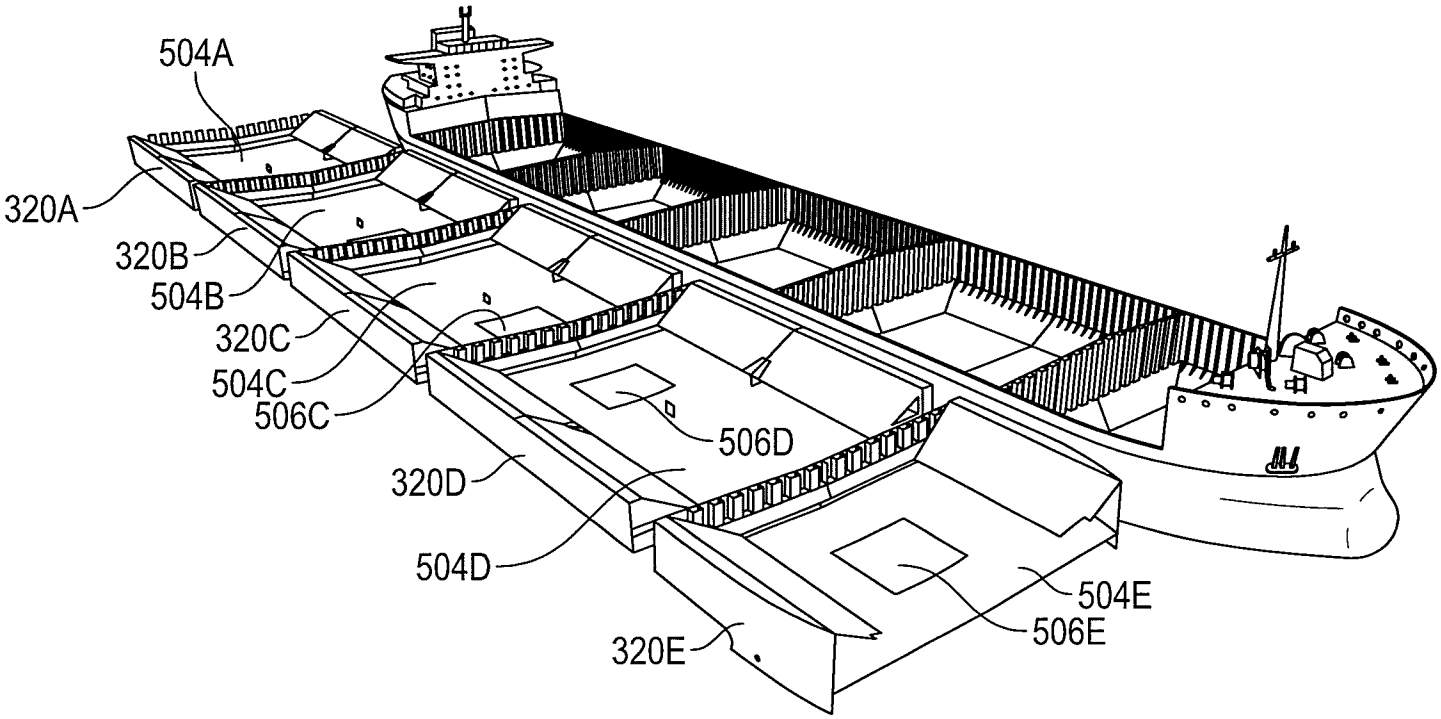
FIG. 5 is an isometric view of a vessel in FIG. 2 illustrating steps 114 and 116 in FIG. 1A.

In step 114, each lateral support member 310, which functions as a stiffener, is removed from each of the plurality of deck sections 320A, 320B, 320C, 320D, 320E, as illustrated in FIG. 5.

In step 116, a new deck 504A, 504B, 504C, 504D, 504E is attached to each of the deck sections 320A, 320B, 320C, 320D, 320E, as illustrated in FIG. 5. Each new deck has a tank dome opening 506C, 506D, 506E therethrough, which is sized to fit about the upper section of a liquefied natural gas tank.

Figure 6:
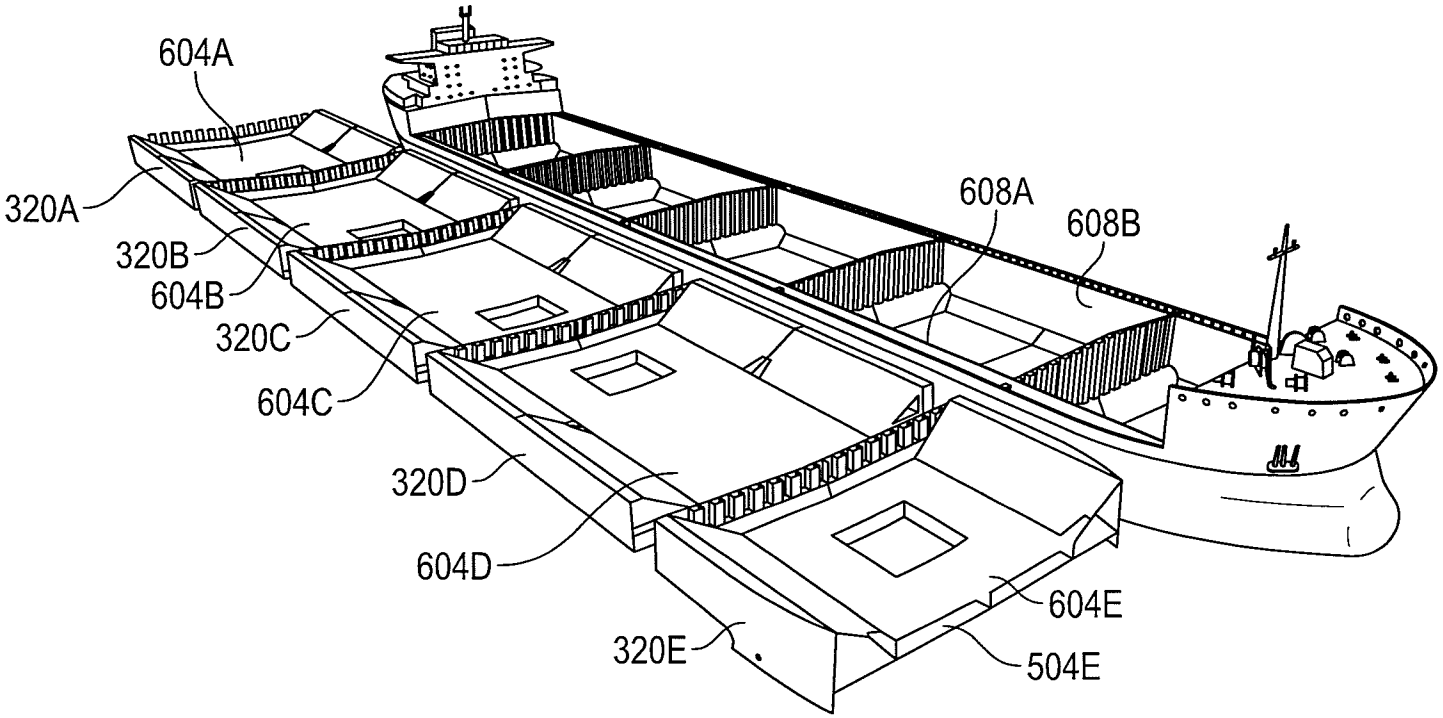
FIG. 6 is an isometric view of a vessel in FIG. 2 illustrating steps 118 in FIG. 1A and 120 in FIG. 1B.

In step 118, a new support member 604A, 604B, 604C, 604D, 604E is attached to each of the plurality of deck sections 320A, 320B, 320C, 320D, 320E as illustrated in FIG. 6, such as by welding. In particular, the new support member 604A, 604B, 604C, 604D, 604E is attached to the new deck 504A, 504B, 504C, 504D, 504E and to the longitudinal support members 302 to provide a strengthened deck and to provide stiffening.

In step 120, an internal second hull 608A, 608B is attached to the lower hull side 318A, 318B of the two hull sides 206A, 206B, as illustrated in FIG. 6, such as by welding.

Figure 7:
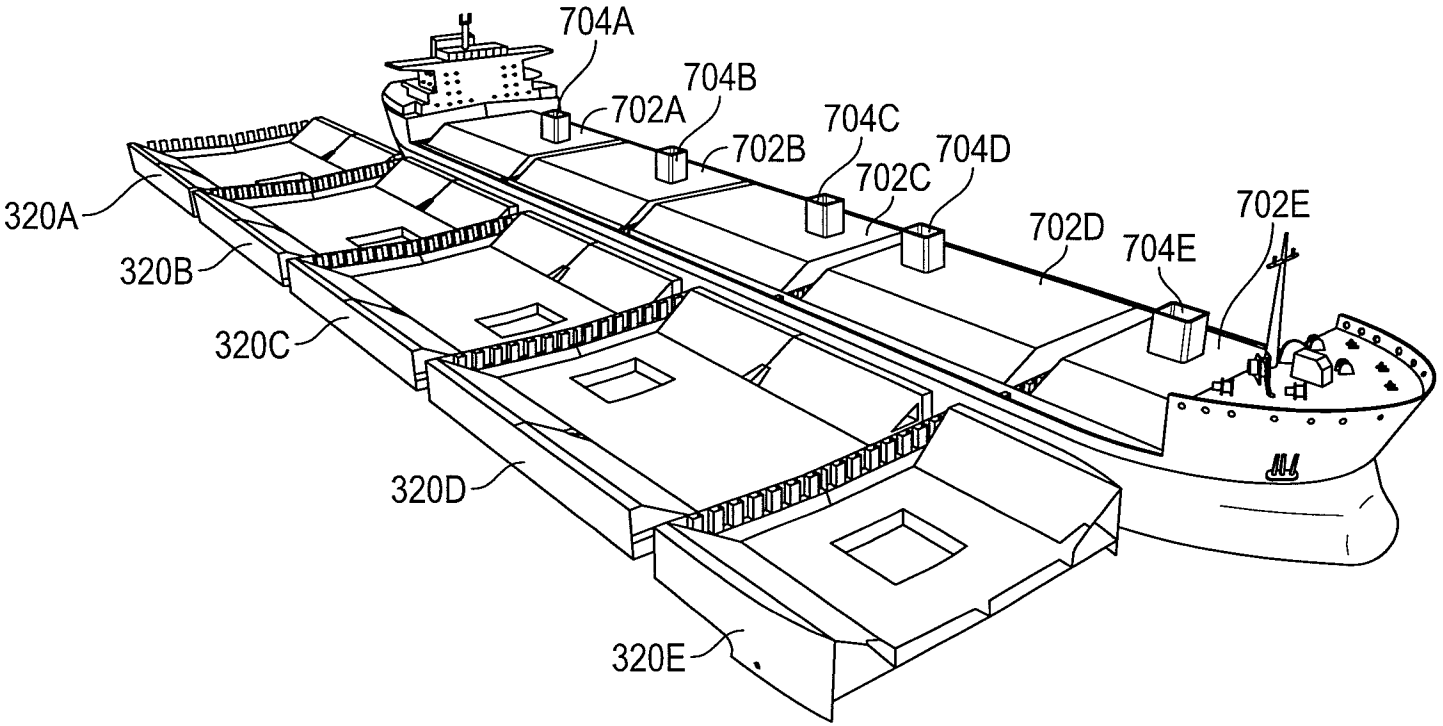
FIG. 7 is an isometric view of a vessel in FIG. 2 illustrating step 122 in FIG. 1B.

In step 122, a liquefied natural gas tank 702A, 702B, 702C, 702D, 702E is positioned in each of the plurality of internal cargo holds 210A, 210B, 210C, 210D, 210E for installation, which may begin at the first internal cargo hold. Each liquefied natural gas tank 702A, 702B, 702C, 702D, 702E has an upper tank section 704A, 704B, 704C, 704D, 704E, as illustrated in FIG. 7. The liquefied natural gas tank 702A, 702B, 702C, 702D, 702E may be an independent Type-B prismatic as illustrated in FIG. 7, or another tank type as needed or developed hereafter.

In step 124, where each of the plurality of deck sections 320A, 320B, 320C, 320D, 320E was rotated 180 degrees in the vertical plane in step 112, each of the plurality of deck sections 320A, 320B, 320C, 320D, 320E are returned to its original orientation by being further rotated 180 degrees in the vertical plane.

Figure 8:
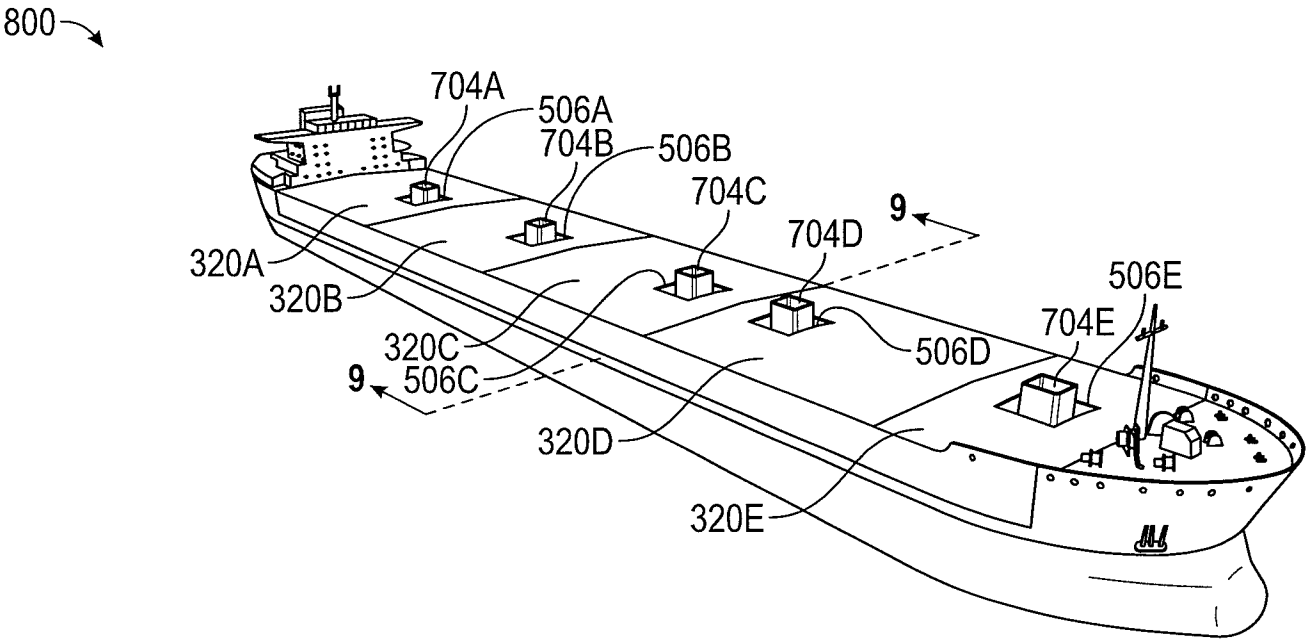
FIG. 8 is an isometric view of a vessel in FIG. 2 illustrating step 126 in FIG. 1B.

In step 126, the plurality of deck sections 320A, 320B, 320C, 320D, 320E are attached to the vessel 202, as illustrated in FIG. 8, which reinstallation may commerce at the bay associated with the first internal cargo hold. The upper tank section 704A, 704B, 704C, 704D, 704E of each of the liquefied natural gas tanks 702A, 702B, 702C, 702D, 702E is aligned with and extends through, and thus is positioned about, the least one tank dome opening 506A, 506B, 506C, 506D, 506E in each of the plurality of deck sections 320A, 320B, 320C, 320D, 320E, completing the functional conversion, as illustrated in FIG. 8, to an FLNG vessel 800.

Figure 9:
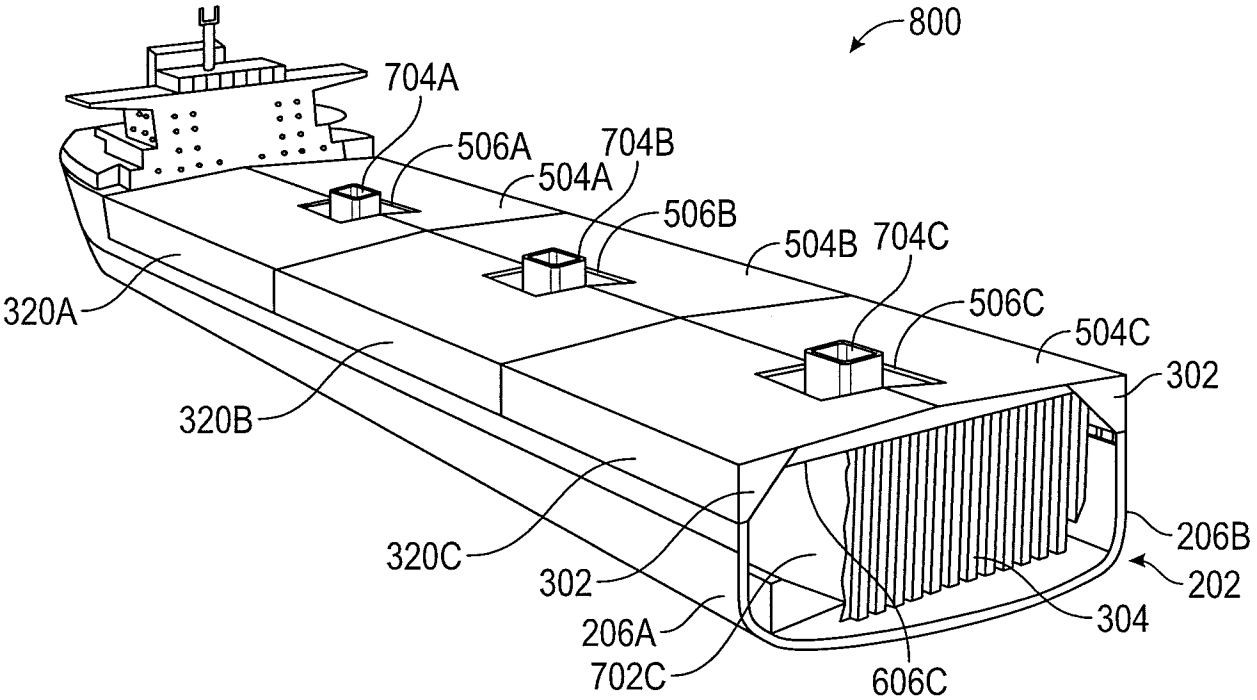
FIG. 9 is an isometric cross-sectional view of the vessel in FIG. 8 taken along line 9-9.

The completed conversion is illustrated by FIG. 9, which provides an isometric cross-section of the FNLG vessel through step 126, along Line 9-9 of FIG. 8.

In step 128, a new hatch coaming may be attached about the tank dome openings 506A, 506B, 506C, 506D, 506E. Other marine equipment may also be installed, as the vessel 800 is now ready for other topsides integration.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for conversion of a floating vessel having internal cargo holds, which comprise:

a) forming a plurality of deck sections;

b) removing the plurality of deck sections from the vessel;

c) removing a deck from each of the plurality of deck sections;

d) rotating each of the plurality of deck sections 180 degrees in vertical plane;

e) removing each lateral support member from each of the plurality of deck sections;

f) attaching a new deck to each of the plurality of deck sections, each new deck having a tank dome opening therethrough;

g) attaching a new support member to each of the plurality of deck sections;

h) attaching an internal second hull to a lower hull side of the vessel;

i) positioning a tank in each of the internal cargo holds, each tank having an upper tank section;

j) rotating further each of the plurality of deck sections 180 degrees in the vertical plane; and k) attaching each deck section to the vessel, wherein each tank dome opening is aligned with the upper tank section.

2. The method of claim 1, wherein the vessel is a Very Large Ore Carrier.

3. The method of claim further comprising the steps of:

dry docking the vessel, cleaning the deck, removing a hatch coaming from each of the plurality of deck sections prior to rotating each of the plurality of deck sections 180 degrees in a vertical plane; and attaching a new hatch coaming about each tank dome opening.

4. The method of claim 1, wherein the tank is an independent Type-B prismatic liquefied natural gas tank.

5. The method of claim 1, wherein forming the plurality of deck sections comprises:

dividing each of the two hull sides of the vessel below a connection of each longitudinal support member to a respective one of the two hull sides into an upper hull side shell and a lower hull side;

dividing a cargo hold inner wall below the connection of one of the plurality of longitudinal support members to one of the hull sides into a cargo hold upper inner wall and a cargo hold lower inner wall; and dividing each upper hull side shell at each of the cargo hold upper inner walls; and dividing the deck at each of the cargo hold upper inner walls.

6. The method claim 1, wherein the deck above each internal cargo hold further includes at least one opening therethrough for communication with the internal cargo hold.

7. The method of claim 1, wherein attaching a new support member to each of the plurality of deck sections further comprises:

attaching the new support member to the new deck; and attaching the new support member to each of the longitudinal support members for strengthening the deck section.

8. A method for conversion of a floating vessel having an internal cargo hold, which comprises:

a) forming a deck section above the internal cargo hold;
b) removing the deck section from the vessel;
c) removing a deck from the deck section;
d) rotating the deck section 180 degrees in a vertical plane;
e) attaching a new deck to the deck section, the new deck having a tank dome opening therethrough;
f) attaching a new support member to the deck section;
g) attaching an internal second hull to a lower hull side of the vessel;
h) positioning a tank in the internal cargo hold, the tank having an upper tank section;
i) further rotating the deck section 180 degrees in the vertical plane; and
j) attaching the deck section to the vessel, wherein the tank dome opening is aligned with the upper tank section.

9. The method of claim 8, wherein the vessel is a Very Large Ore Carrier.

10. The method of claim 8, further comprising the steps of:

dry docking the vessel, cleaning the deck, removing a hatch coaming from the deck section prior to rotating the deck section 180 degrees in a vertical plane; and attaching a new hatch coaming about the tank dome opening.

11. The method of claim 8, wherein the tank is an independent Type-B prismatic liquefied natural gas tank.

12. The method of claim 8, wherein forming the deck section comprises:

dividing each of the two hull sides of the vessel below a connection of each longitudinal support member to a respective one of the two hull sides into an upper hull side shell and a lower hull side;

dividing a cargo hold inner wall below the connection of one of the plurality of longitudinal support members to one of the hull sides into a cargo hold upper inner wall and a cargo hold lower inner wall;

dividing each upper hull side shell at a cargo hold upper inner wall adjacent the internal cargo hold; and dividing the deck at the cargo hold upper inner wall adjacent the internal cargo hold.

13. The method claim 8, wherein the deck above the internal cargo hold further includes an opening therethrough for communication with the internal cargo hold.

14. The method of claim 8, wherein attaching a new support member to the deck section further comprises:

attaching the new support member to the new deck; and attaching the new support member to each of the longitudinal support members for strengthening the deck section.

* * * * *